United States Patent [19]

DiMarco et al.

[11] Patent Number: 4,594,567

[45] Date of Patent: Jun. 10, 1986

[54] CIRCUIT BREAKER CONTACT ARM ASSEMBLY HAVING A MAGNETIC CARRIER

[75] Inventors: Bernard DiMarco, Lilburn, Ga.; Charles W. Stanford, Bellefontaine, Ohio

[73] Assignee: Siemens-Allis, Inc., Atlanta, Ga.

[21] Appl. No.: 656,150

[22] Filed: Sep. 28, 1984

[51] Int. Cl.[4] ..... H01H 75/02

[52] U.S. Cl. ..... 335/16; 335/42; 335/195

[58] Field of Search ..... 335/16, 38, 42, 165, 335/174, 195, 202

[56] References Cited

U.S. PATENT DOCUMENTS

| | | | |
|---|---|---|---|
| 3,824,508 | 7/1974 | Terracol | 335/16 |
| 3,887,888 | 6/1975 | Bayles et al. | 335/16 X |
| 4,488,133 | 12/1984 | McClellan et al. | 335/16 |

*Primary Examiner*—George Harris

*Attorney, Agent, or Firm*—F. W. Powers; J. L. James

[57] ABSTRACT

A blow open contact arm assembly is provided for a molded case circuit breaker. A ferromagnetic carrier is attached to the movable contact arm and is positioned thereabout for creating a magnetic field about the movable contact arm which attracts the contact arm to the open position during severe fault conditions. The molded case housing has reinforced walls to withstand the pressures exerted on the walls of the houses during a blow open operation of the contacts.

8 Claims, 5 Drawing Figures

CIRCUIT BREAKER CONTACT ARM ASSEMBLY HAVING A MAGNETIC CARRIER

CROSS REFERENCES TO RELATED APPLICATIONS

The subject matter described in this application is related to the material disclosed in co-filed U.S. patent applications Ser. No. 656,236 "A Molded Case Circuit Breaker Having A Reinforced Housing"—B. DiMarco and C. W. Stanford, Ser. No. 656,233 "Multi-Pole Molded Case Circuit Breaker With A Common Contact Operating Crossbar Member"—B. DiMarco and C. W. Stanford, and Ser. No. 656,230 "Magnetic Structure For Calibrating A Circuit Breaker"—J. W. Young.

BACKGROUND OF THE INVENTION

This invention relates to a circuit breaker having blow open contacts and more particularly to a magnetic carrier arrangement for reinforcing blow open force.

A current interrupting mechanism called a blow open mechanism is commonly used to handle massive overcurrent conditions to instantaneously open during the first milliseconds that a massive overcurrent condition exists. It is important that the contacts open quickly to interrupt the high current and to prevent the build-up of heat in the circuit breaker. Because of present efforts to reduce the physical dimensions of circuit breakers and other electrical equipment, circuit breaker mechanisms have been made compact; yet, increased performance has been demanded of these breakers. With this reduction in space, there has been an increased need to open the contacts rapidly upon the occurrence of the massive overcurrent condition to prevent damage to the circuit breaker.

Typically, the blow open force is supplied by arranging the contact arms of the blow open assembly so that the current flowing through the fixed contact arm goes along a path which sets up a magnetic field which is opposite to the magnetic field set-up in the movable contact arm. The opposing magnetic fields produce the force to blow the contacts apart. Naturally, the strength of the magnetic field can be influenced by the length and spacing of the contact arms. If space were not a limiting factor, the contact arms could simply be made longer to get a greater blow open effect for a fault current condition. But space is a limiting factor and other means are necessary to derive sufficient blow open force. Accordingly, it will be appreciated that it would be highly desirable to provide a way to increase the magnetic blow open force in the given space.

Accordingly, it is an object of the present invention to provide a contact arm assembly which reinforces the magnetic blow open forces for faster opening upon the occurrence of a fault.

Another object of the invention is to provide a blow open contact assembly which does not increase the physical dimensions of the circuit breaker.

SUMMARY OF THE INVENTION

Briefly stated, in accordance with one aspect of the invention, the foregoing objects are achieved by providing a blow open contact arm assembly which has a ferromagnetic carrier attached to the movable contact and positioned thereabout for creating a magnetic field about the movable contact arm which attracts the arm to the open position.

The ferromagnetic carrier assists during the blow open operation without increasing the overall physical dimensions of the circuit breaker and without interfering with the other operating functions of the circuit breaker.

BRIEF DESCRIPTION OF THE DRAWINGS

While the specification concludes with claims particularly pointing out and distinctly claiming the subject matter which is regarded as the invention, it is believed that the invention would be better understood from the following description of the preferred embodiment taken in conjunction with the accompanying drawings in which:

DESCRIPTION OF A PREFERRED EMBODIMENT

Figure 1:
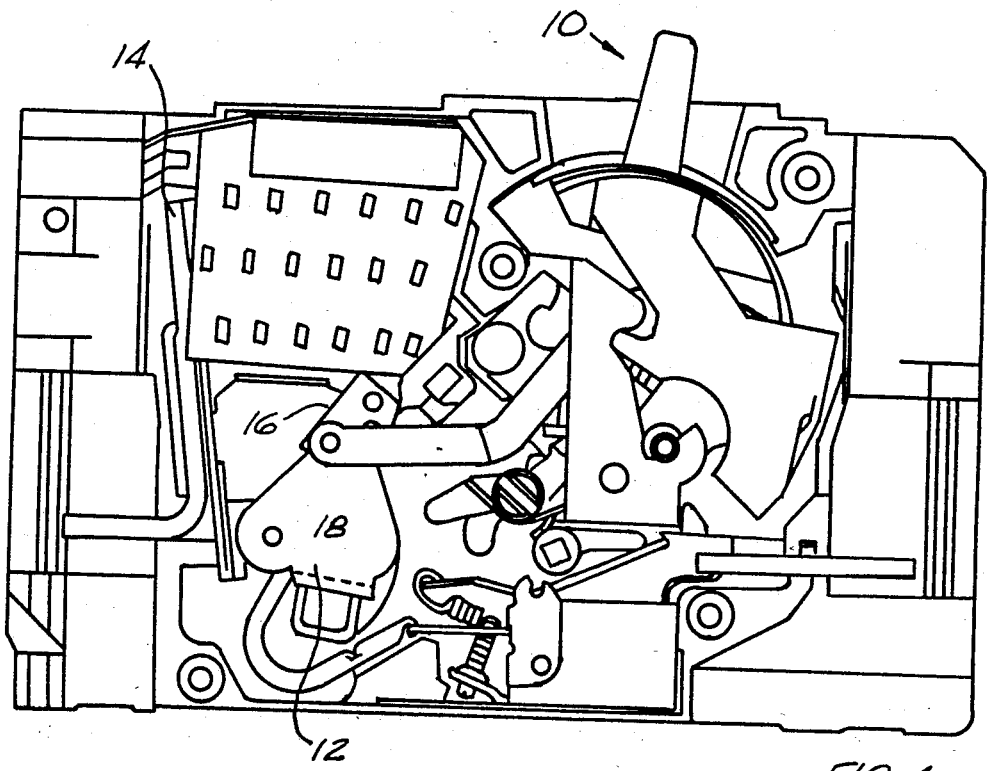
FIG. 1 is a diagrammatic view of a circuit breaker pole with the cover removed exposing the blow open contact arm assembly.
Figure 3:
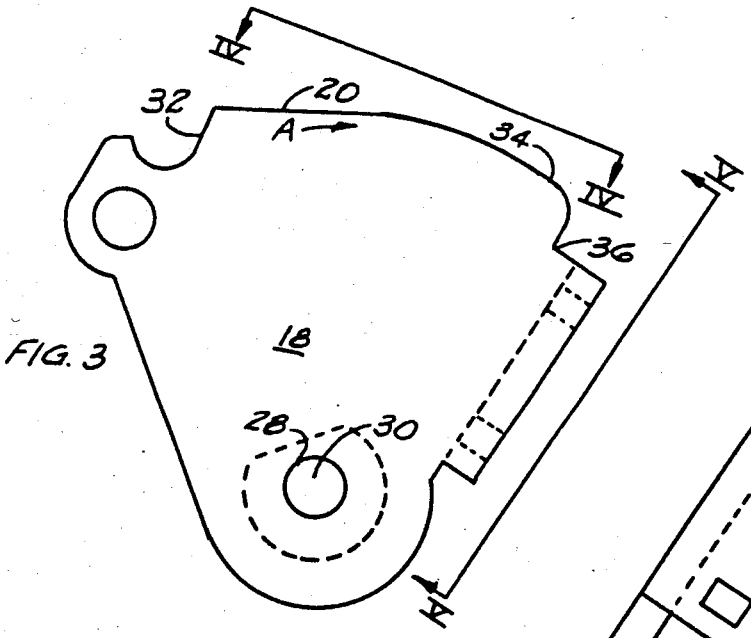
FIG. 3 is a diagrammatic view of the carrier of the contact arm assembly shown in FIG. 2.
Figure 5:
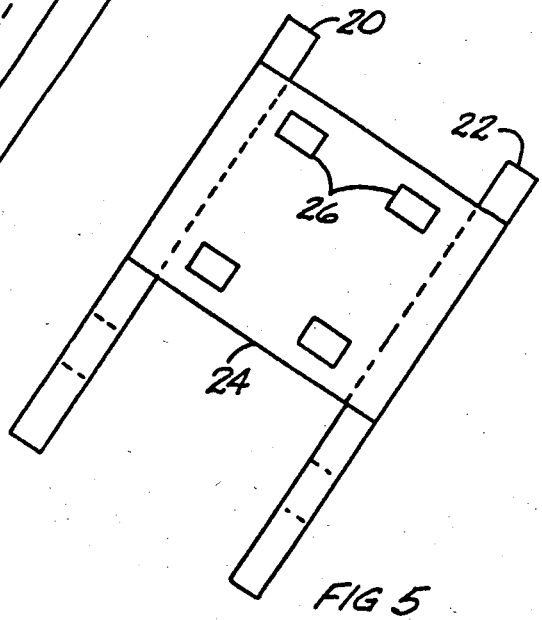
FIG. 5 is a view taken along line 5 of FIG. 3.
Figure 4:
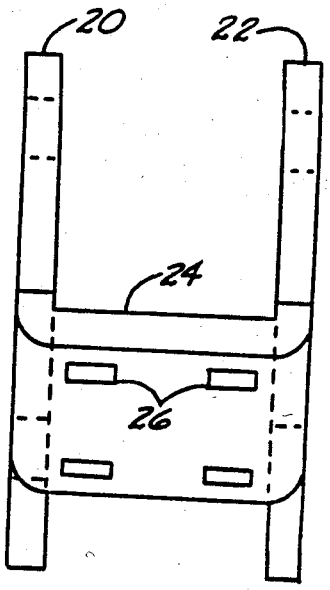
FIG. 4 is a view taken along line 4 of FIG. 3.

Referring to FIG. 1, a circuit breaker pole 10 has a contact arm assembly 12 which includes a stationary contact 14 and a movable contact 16 with a current flow path such that current flows from one contact arm through the contacts and the other contact arm. This sets up opposing magnetic fields which urge the contact arms 14 and 16 apart and separate the contacts when the magnitude of the current reaches massive over current levels as are experienced during fault conditions.

Figure 2:
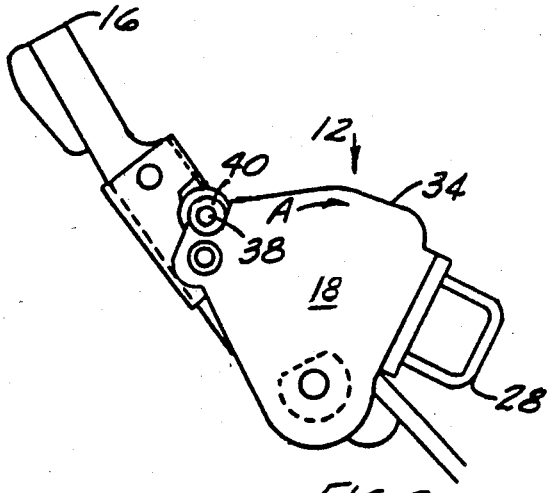
FIG. 2 is a somewhat enlarged view of the contact arm assembly shown in FIG. 1.

Referring to FIG. 2, the contact arm assembly 12 contains a carrier 18 which is connected to the movable contact arm. The carrier 18 is attached to the movable contact arm 16 and positioned thereabout for creating a magnetic field about the movable contact arm thereby assisting the magnetic blow open forces which separate the contact arms in response to massive over current conditions.

Referring to FIGS. 2–5, the carrier 18 is a generally U-shaped member having parallel arms 20, 22 connected by a rectangular member 24 having apertures 26 which receive gripping ears (not shown) extending from bracket 28. Each of the arms 20, 22 is identical and the mirror image of the other so that only arm 20 will be described in detail. Arm 20 includes aperture 28 through which contact arm pivot pin 30 extends. The edge of arm 20 remote from aperture 28 is provided with cam depression 32 and relatively long cam formation 34 adjacent to depression 32. At the end of formation 34, the edge having cam formation 34 is provided with depression 36 which, in a manner to be hereinafter explained, limits opening motion of the contact arm 16 during blow off.

A traverse pin 38 is attached to the movable contact arm 16. The pin 38 has a cam follower roller 40 attached to each end. A pair of coiled tension springs (not shown) secured to pivot pin 30 and traverse pin 38, one on either side of the contact arm 16 inboard of the cam follower rollers 40. The springs bias cam followers 40 toward contact arm pivot 30 and against the surfaces of carrier 18 having cam formations 34.

Under normal operating conditions, cam followers 40 are in depressions 32 so that as the arm assembly 12 is operated between its open and closed positions, contact arms 14, 16 will be disengaged and engaged, respectively. However, with contact arms 14, 16 engaged, if severe overload current conditions occur, electrodynamic forces acting to separate contacts 14, 16 will move contact arm 16 to its open position. When this occurs, initial movement of contact arm 16 in the circuit opening direction moves followers 40 in the upward direction with respect to FIGS. 2 or 3 until they leave the cam depression 32 and arrive at cam formation 36. The boundary 34 between cam formations 34, 36 is the overcenter position for contact arm 16. That is, when cam follower 40 moving in the contact opening direction indicated by arrow A leaves cam depression 32 and moves past point 34, the action of the springs biases follower 40 in the direction of arrow A. The curvature of cam formation 34 may be chosen so that for initial movement of follower 40 after it leaves cam depression 32 movement will be rapid. Such movement will slow somewhat as follower 40 approaches point 34 due to the springs so that by the time follower 40 engages depression 36, even though it is being biased in the opening position indicated by arrow A, there is no danger that it will move beyond depression 36. In addition, the deceleration of follower 40 is such that there is no danger of contact arm 16 rebounding toward closed circuit position after being driven to open circuit position by electrodynamic forces which accompany severe overload currents.

The tripping mechanism is so constructed that the initial opening motion of the contact arms 14, 16 actuate the tripping mechanism of the breaker pole 10. Movement of the carrier 18 to the open position will cause relative movement between the carrier 18 and contact arm 16 to bring the cam follower roller 40 into cam depression 32.

For the most part, cam follower 40 is normally seated in the deepest portion of cam pocket 32. This condition exists during closing movement of contact arm 16, up to the point where there is initial engagement of movable contact arm 16 with stationary contact arm 14. However, carrier 18 continues to move in the closing direction (clockwise with respect to FIG. 2) and by so doing, follower 40 is engaged by the edge of cam depression 32. This forces transverse pin 38 to move slightly away from pivot 30 thereby additionally tensioning the springs. Even though the line of action of the springs is generally longitudinal with respect to contact arm 16, the angular relationship between cam surface portion 34 and follower 40 results in a relatively strong component of force in the contact closing direction.

The shape of cam section 34 is tailored so that during electrodynamic blow off, as soon as follower 40 moves beyond point 34, contact arm 16 is effectively in an overcenter position in the circuit opening direction. It is seen that this latter condition is achieved after relatively little movement of contact arm 16 in the opening direction. As explained more fully below, the present invention enhances the initial opening to the contacts by reinforcing the magnetic fields responsible for the flow open motion when fault current conditions appear.

Normally electrodynamic blow off forces which open circuit breaker 10 during severe fault current conditions result from interactions of magnetic fields that accompany currents flowing in the stationary contact arm 14 and the movable contact arm 16.

The movable contact arms 16 is very closely spaced from the stationary contact arm 14. Each contact arm has a contact attached to the end thereof which is coated or constructed of silver or other highly conductive material as is known in the art. The current flow is such that current flows through the stationary contact to the contact affixed to the stationary contact to the contact affixed to the movable contact arm and finally through the contact arm. The contact arms lie in substantially parallel relation so that the current flow in the arms is in opposite directions along the parallel portion of their lengths. This sets up opposing magnetic fields.

Since the initial opening motion of the contacts is dependent upon the strength of the magnetic field, increasing the magnetic field strength would increase the initial blow open magnetic force. The U-shaped carrier 18 has been constructed of a magnetic material, such as magnetic steel for example, which attracts the magnetic field toward the closed end of the U. In this way, the movable contact arm 16 will be attracted toward the closed end of the carrier 18 which is the open position. Thus, the magnetic field is reinforced by the carrier to assure successful blow open operation under fault conditions. The same magnetic attractive force tends to keep the contact 16 in the open position.

As will be evident from the foregoing description, certain aspects of the invention are not limited to the particular details of the examples illustrated, and it is therefore contemplated that other modifications or applications will occur to those skilled in the art. It is accordingly intended that the claims shall cover all such modifications and applications as do not depart from the true script and spirit of the invention.

What is claimed as new and desired to be secured by Letters Patent of the United States is:

1. A blow open contact arm assembly for a circuit breaker, comprising:

an electrically conductive stationary contact arm having a preselected length with a contact fixed on one end;

an electrically conductive movable contact arm having a preselected length with a contact fixed on one end, said contact arms being positioned in generally parallel relation in the closed position where a current flow from one contact arm through contacts through the other contact arm creates opposing magnetic fields which force the arms to move apart in response to current flow of a preselected magnitude; and a ferromagnetic carrier attached to the movable contact arm and positioned thereabout for creating a magnetic field about the movable contact arm thereby attracting the arm to an open position.

2. A contact arm assembly, as set forth in claim 1, wherein the carrier has a generally U-shaped configuration and the arm is attracted toward the bottom of the U.

3. A blow open contact arm assembly, as set forth in claim 1, including a bracket connected to the ferromagnetic carrier.

4. A blow open contact arm assembly, as set forth in claim 1, wherein the ferromagnetic carrier is constructed of magnetic steel.

5. A blow open contact arm assembly, as set forth in claim 1, wherein the bottom edges of the carrier are parallel with the bottom edge of the contact arm.

6. A blow open contact arm assembly, as set forth in claim 1, wherein the carrier has a generally U-shaped configuration with parallel arms which have an edge portion which lies generally parallel with the movable contact arm.

7. A blow open contact arm assembly, as set forth in claim 6, wherein the edges of the carrier arm lie substantially parallel to the stationary contact arm in the closed position.

8. A contact arm assembly, as set forth in claim 1, wherein the carrier has a generally U-shaped configuration with parallel arms having edge portions lying substantially parallel to the stationary and movable contact arms in the closed position, said generally U-shaped carrier becoming a horseshoe magnet during blow off.

* * * * *